US006189711B1

(12) United States Patent
Chang

(10) Patent No.: US 6,189,711 B1
(45) Date of Patent: Feb. 20, 2001

(54) SUPPORT DEVICE FOR STATIONERY GOODS

(76) Inventor: Chun Yuan Chang, P.O. Box 63-99, Taichung (TW), 406

( * ) Notice: Under 35 U.S.C. 154(b), the term of this patent shall be extended for 0 days.

(21) Appl. No.: 09/427,519

(22) Filed: Oct. 25, 1999

(51) Int. Cl.[7] ..... A47F 7/00

(52) U.S. Cl. ..... 211/163; D19/77; D19/85; 211/11; 211/40; 211/69.1; 211/13.1

(58) Field of Search ..... 211/13.1, 163, 211/11, 77, 78, 69.1, 70, 40, 50; D19/77, 84, 85

(56) References Cited

U.S. PATENT DOCUMENTS

D. 321,011 * 10/1991 Blossom ..... D19/85 X
D. 340,071 * 10/1993 Sun ..... D19/85 X
D. 347,657 * 6/1994 Evenson ..... D19/90
D. 390,266 * 2/1998 Cheris et al. ..... D19/55 X
D. 407,753 * 4/1999 Kwok ..... D19/77
D. 418,947 * 1/2000 Greiner ..... D19/77 X
D. 428,624 * 7/2000 Kwok ..... D19/77
4,953,696 * 9/1990 Huang et al. ..... 211/70 X
5,377,850 * 1/1995 Liaw ..... 211/163
5,641,080 * 6/1997 Humphrey et al. ..... 211/77

* cited by examiner

*Primary Examiner*—Robert W. Gibson, Jr.

(57) ABSTRACT

A support device for receiving and supporting official device elements includes a casing rotatably secured on a base. The casing includes two groups of opposite partitions disposed in a peripheral wall for forming two or more spaces within the casing and for receiving the official device elements. The partitions are parallel to each other for forming one or more channels and for receiving discs or the like. The partitions each includes a curved inner end connected to each other for forming a barrel, and include a height greater than the peripheral wall for allowing the official device elements to be easily obtained.

9 Claims, 5 Drawing Sheets

SUPPORT DEVICE FOR STATIONERY GOODS

BACKGROUND OF THE INVENTION

1. Field of the Invention

The present invention relates to a support device, and more particularly to a support device for stationery goods.

2. Description of the Prior Art

A typical stationery goods support device is shown in FIG. 5 and comprises a housing 80 having one or more partitions 81 for forming one or more spaces 82 and for receiving and carrying the stationery goods or the official supply or the office device elements, such as the paper clips, the staplers, the staple removers, the scissors, the knives, rulers, pens, etc. However, the user may not easily obtain the required goods. In addition, the compact discs and the floppy discs have been widely used now. The typical support devices may not be used for supporting the stationery goods.

The present invention has arisen to mitigate and/or obviate the afore-described disadvantages of the conventional stationery goods support devices.

SUMMARY OF THE INVENTION

The primary objective of the present invention is to provide a support device which is rotatable for allowing the user to easily obtain the required goods.

The other objective of the present invention is to provide a support device which is usable for supporting compact discs and/or floppy discs.

In accordance with one aspect of the invention, there is provided a support device for supporting official device elements comprising a base, a casing including a bottom plate having a peripheral portion, the casing including two halves, and two groups of partitions extended upward from the bottom plate and disposed in the two halves of the casing respectively for defining at least two channels in the casing and for receiving the official device elements, and means for rotatably securing the casing to the base.

The securing means includes a spring-biased catch disposed on the base and engaged into the casing for rotatably securing the casing to the base. The casing includes a peripheral wall, the groups of partitions are provided in the peripheral wall for defining the at least two spaces in the casing and between the peripheral wall and the groups of partitions.

The groups of partitions each includes an inner partition and an outer partition, the partitions of a first of the groups of partitions each includes a curved inner end connected to the inner partition of a second of the groups of partitions and each includes an outer end connected to the peripheral wall.

The curved inner ends of the inner partitions of the groups of partitions are coupled together to form a barrel. The peripheral wall includes at least one cut portion for receiving the outer ends of the partitions. The inner partition of the groups of partitions includes a height greater than that of the outer partition. One or more intermediate partitions are further disposed between the inner partition and the outer partition of each group of the partitions.

The peripheral wall includes a height smaller than that of the groups of partitions. One or more panels are further provided and coupled between the partitions for forming a plurality of spaces in the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
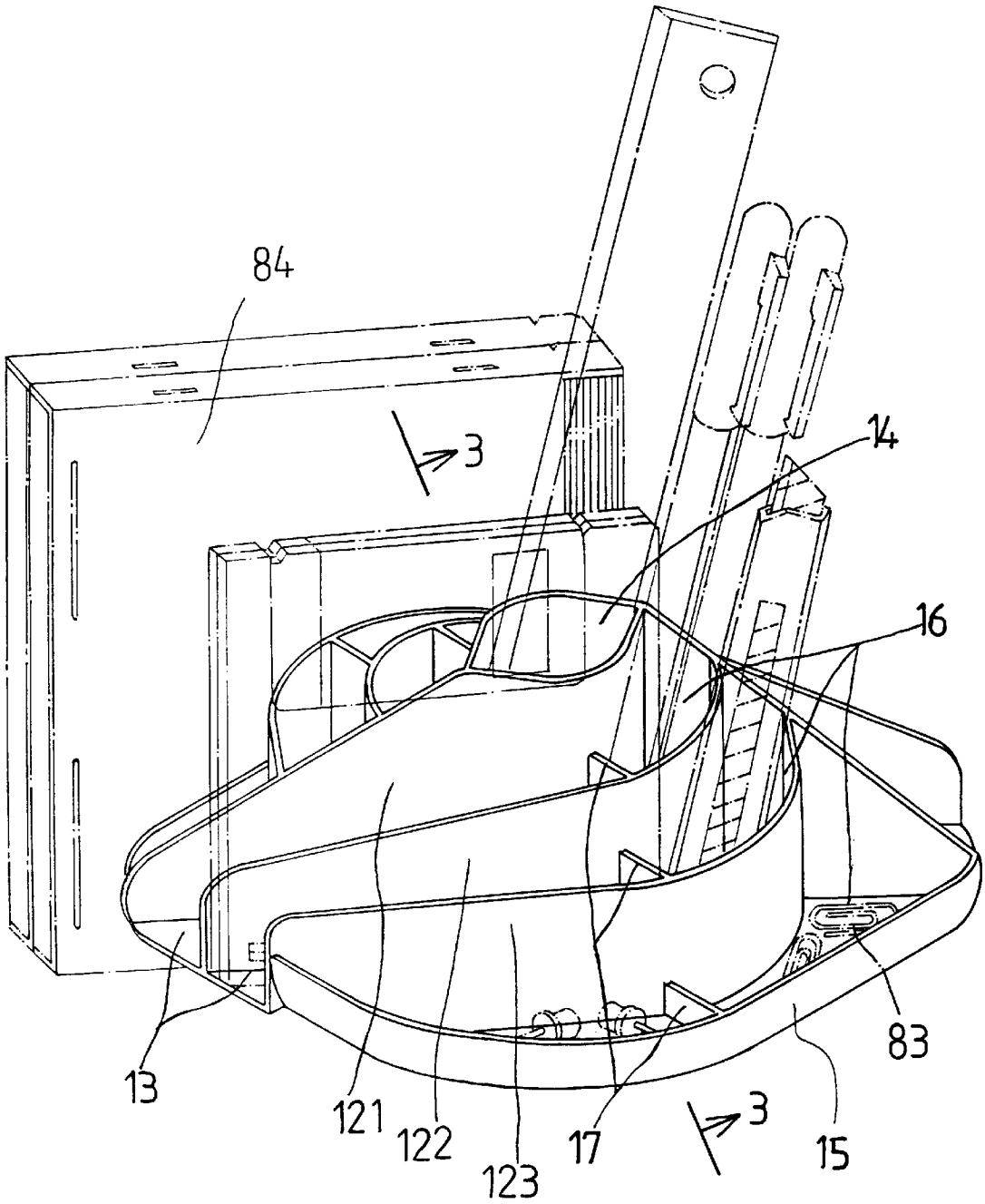
FIG. 1 is a perspective view of a support device in accordance with the present invention.
Figure 2:
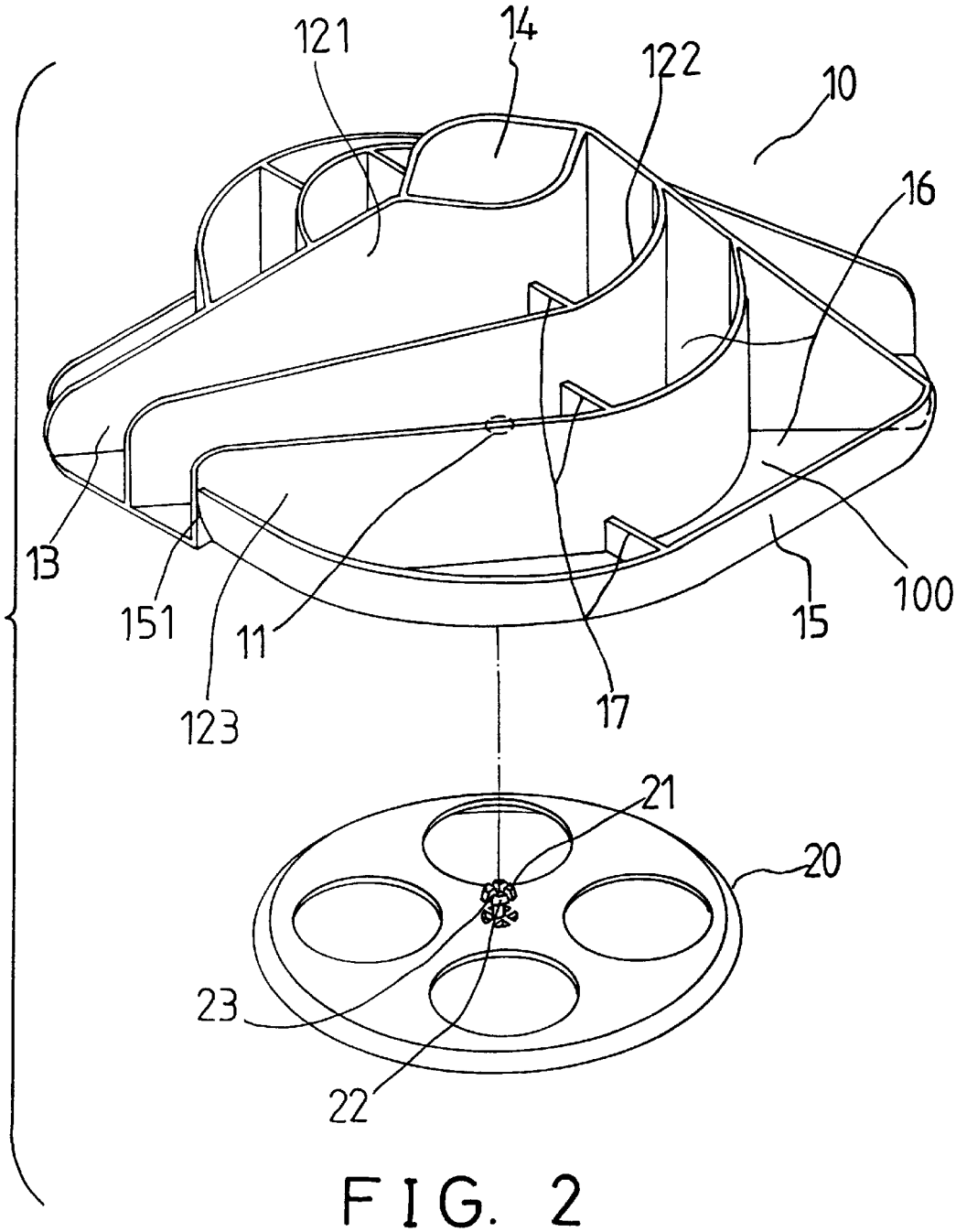
FIG. 2 is an exploded view of the support device.
Figure 3:
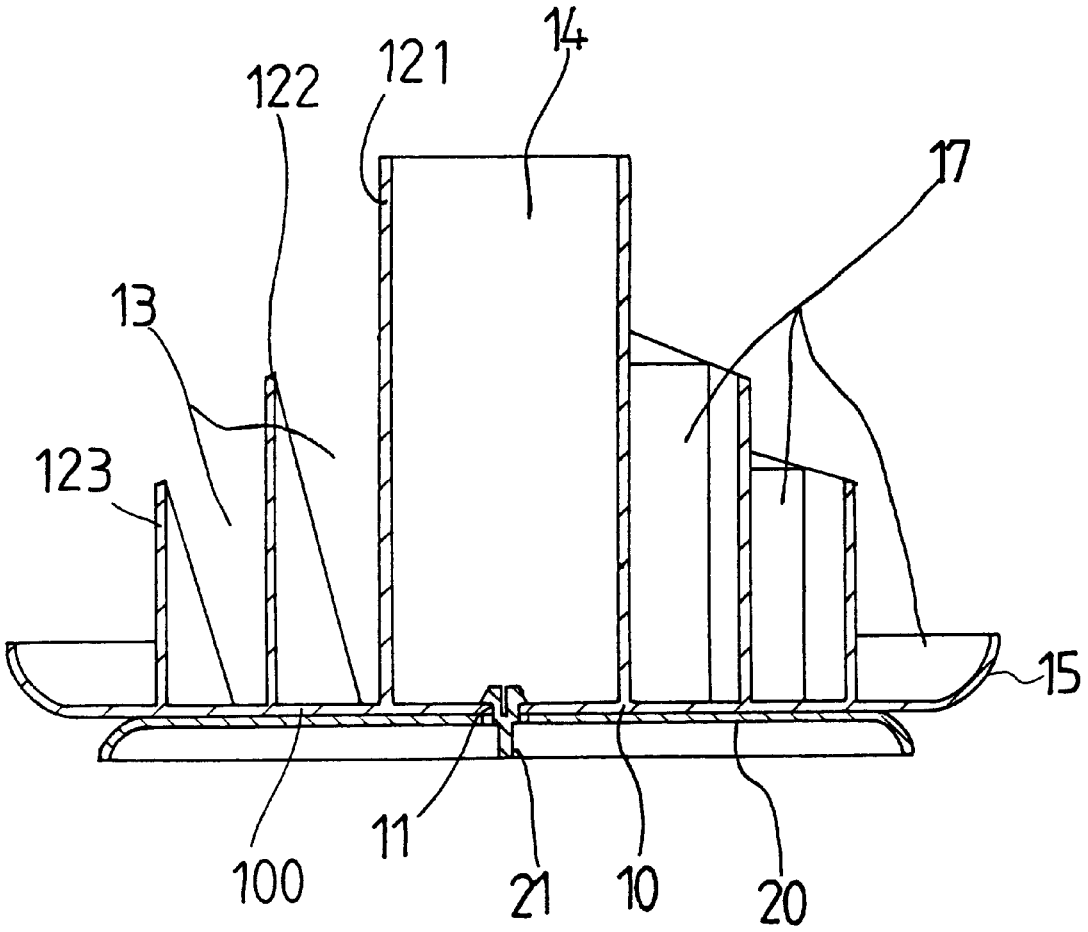
FIG. 3 is a cross sectional view taken along lines 3—3 of FIG. 1.

Referring to FIGS. 1–4 of the drawings, a support device in accordance with the present invention comprises a base 20 including a spring-biased catch 21 provided thereon, and preferably extended upward therefrom, and particularly extended upward from the center portion thereof. The catch 21 includes a head having one or more resilient blades or blocks 22 formed therein and separated from each other by slits 23 or the like, for forming the spring-biased structure to the catch 21. A support casing 10 includes a latch opening 11 formed in the bottom thereof and preferably located in the center thereof for receiving the spring-biased catch 21 and for rotatably securing the casing 10 to the base 20, and for allowing the casing 10 to be rotated relative to said base 20.

Figure 4:
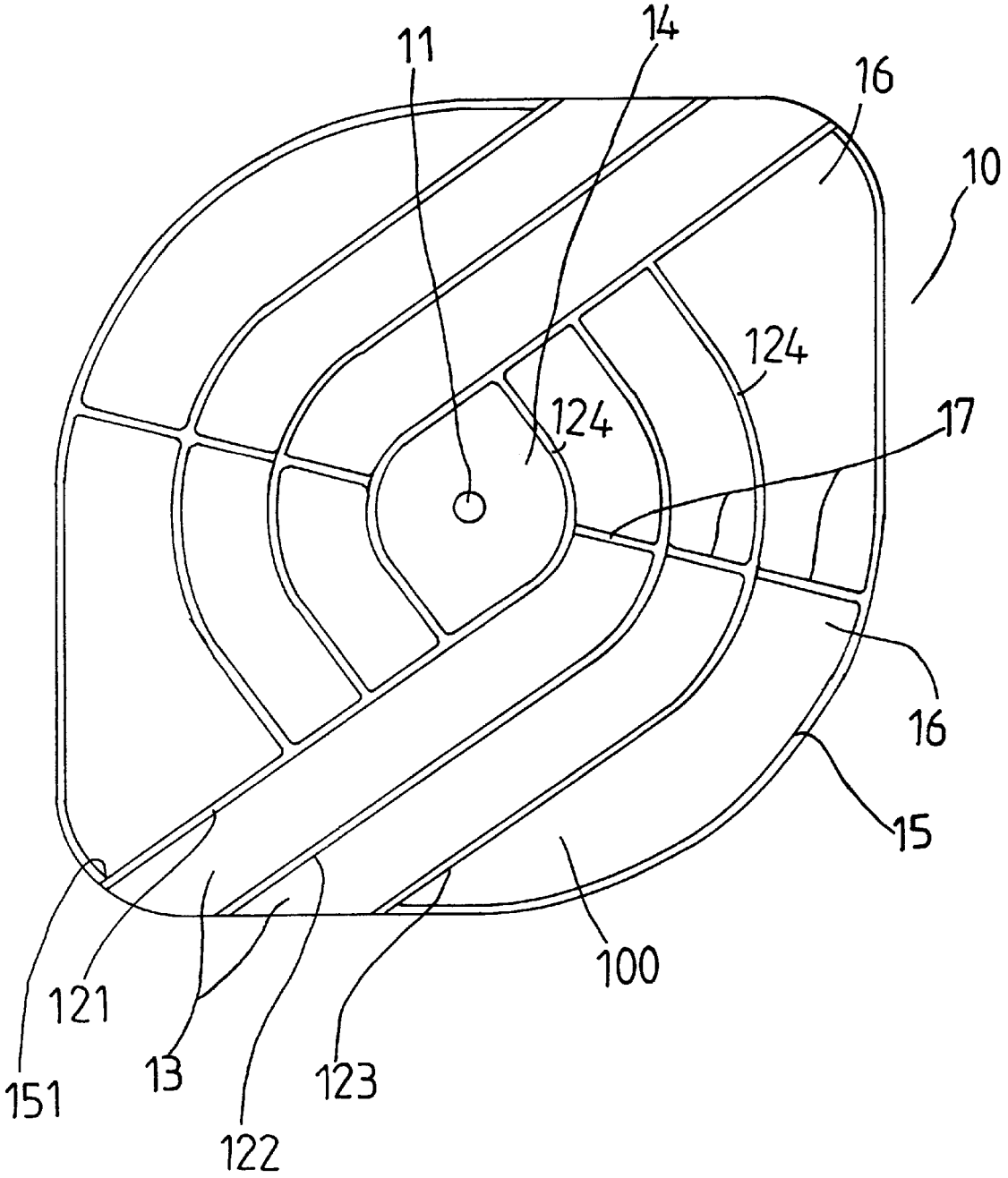
FIG. 4 is a top view of the support device.
Figure 5:
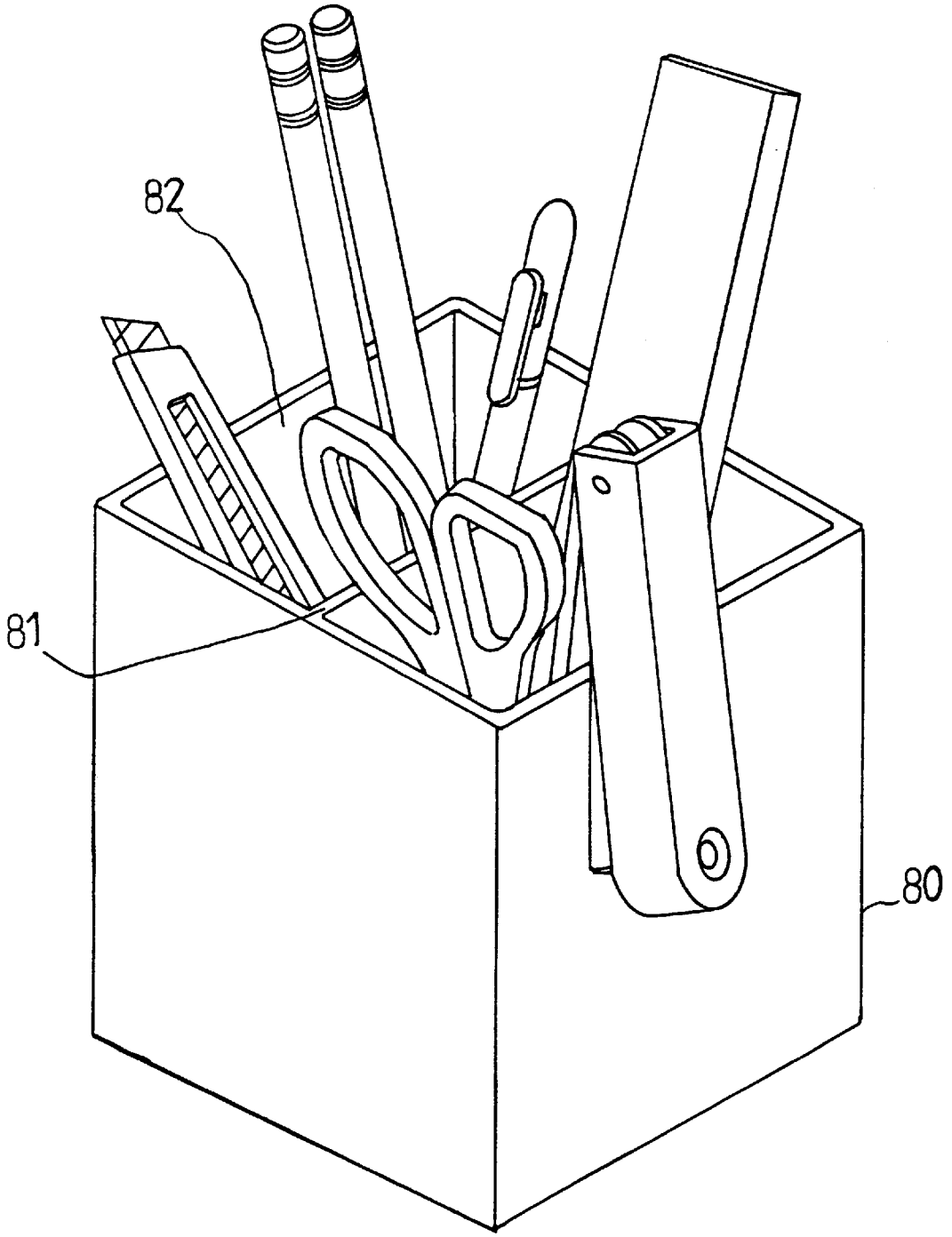
FIG. 5 PRIOR ART
FIG. 5 is a perspective view illustrating the typical support device for stationery goods.

The casing 10 includes a bottom plate 100, and a peripheral wall 15 extended upward from the peripheral portion of the bottom plate 100 of the casing 10. Two or more parallel partitions 121, 122, 123 are extended upward from the peripheral portion of the bottom plate 100 of the casing 10 for forming one or more channels 13 and for receiving the official device elements, such as the compact discs and/or the floppy discs 84. The peripheral wall 15 includes one or more cut portions 151 formed therein for receiving the end portions of the partitions 121–123 and for forming flat bottoms for the channels 13 of the support device. The casing 10 includes two groups of partitions 121–123 disposed opposite to each other or are disposed on two opposite halves of the casing 10. Each group includes three partitions 121–123. As shown in FIG. 4, the partitions 121–123 are parallel to each other and each includes a curved inner portion 124 connected to the partition 121 of the opposite group of partitions. The curved inner portions 124 of the radially innermost partitions 121 are connected to each other for forming a barrel 14 and for receiving the official device elements 83 having a greater length, such as the rules.

Two spaces 26 are formed between the two radially outer partitions 123 and the outer peripheral wall 15 and the outer end portions of the partitions 121. One or more panels 17 are formed and provided in the casing 10 and engaged with the partitions 121–123 and the peripheral wall 15 for forming many more spaces 16 in the casing 10 and for receiving various kinds of official device elements 83 therein (FIG. 1). It is preferable that the peripheral wall 15 of the casing 10 includes a height equals to or smaller than the outermost partition 123; and the partitions 12 include a height decreasing from the curved inner portions 124 thereof toward the end portions thereof; i.e., the curved inner portions 124 of the partitions 121–123 has a height greater than the other portion thereof, such that the barrel 14 includes a height greater than the other portions of the partitions 12 for receiving the official device elements 83 of greater lengths, and such that the official device elements 83 received in spaces 16 that are located in the outer or peripheral portion of the casing 10 will be easily obtained. The inner partition 121 has a height greater than that of the intermediate partition 122 which has a height greater than that of the outer partition 123.

In operation, the casing 10 may be rotated relative to the base 20 such that the official device elements 83 (FIG. 1) may be easily obtained by the user. In addition, the official device elements 83 that are received in spaces 16 and that are located in the outer or peripheral portion of the casing 10 may be easily obtained by the users due to the decreasing height of the partitions 121–123 from the inner portions toward the outer or end portions thereof.

Accordingly, the support device in accordance with the present invention includes a rotatable structure for allowing the user to easily obtain the required goods and includes a structure for supporting compact discs and/or floppy discs.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A support device for receiving and supporting objects, said support device comprising:

a base, a casing including a bottom plate having a peripheral portion, said casing including two halves, and two groups of partitions extended upward from said bottom plate and disposed in said two halves of said casing respectively for defining at least two channels in said casing and for receiving the objects, and means for rotatably securing said casing to said base, wherein said casing includes a peripheral wall, said two groups of partitions each includes an inner partition and an outer partition, said partitions of a first of said groups of partitions each includes a curved inner end connected to said inner Partition of a second of said groups of partitions and each includes an outer end connected to said peripheral wall.

2. The support device according to claim 1, wherein said rotatably securing means includes a spring-biased catch disposed on said base and engaged into said casing for rotatably securing said casing to said base.

3. The support device according to claim 1, wherein said casing includes a peripheral wall, said groups of partitions are provided in said peripheral wall of said casing for defining said at least two spaces in said casing and between said peripheral wall and said groups of partitions.

4. The support device according to claim 1, wherein said curved inner ends of said inner partitions of said groups of partitions are coupled together to form a barrel.

5. The support device according to claim 1, wherein said peripheral wall includes at least one cut portion for receiving said outer ends of said partitions.

6. The support device according to claim 1, wherein said inner partition of said groups of partitions includes a height greater than that of said outer partition.

7. The support device according to claim 1 further comprising at least one intermediate partition disposed between said inner partition and said outer partition of each group of said partitions.

8. The support device according to claim 1, wherein said peripheral wall includes a height smaller than that of said groups of partitions.

9. The support device according to claim 1 further comprising at least one panel coupled between said partitions for forming a plurality of spaces in said casing.

* * * * *